United States Patent [19]

Mattson et al.

[11] 4,346,526

[45] Aug. 31, 1982

[54] SNOW THROWER

[75] Inventors: Charles A. Mattson, Woodland Hills; James J. Michel, Agoura, both of Calif.

[73] Assignee: Allegretti & Company, Chatsworth, Calif.

[21] Appl. No.: 136,892

[22] Filed: Apr. 3, 1980

[51] Int. Cl.[3] ..... E01H 5/00

[52] U.S. Cl. ..... 37/259; 37/262

[58] Field of Search ..... 37/43 R, 43 A, 43 B, 37/43 C, 43 D, 43 E, 43 F, 43 G, 43 H, 43 K, 43 L, 53, 20–27

[56] References Cited

U.S. PATENT DOCUMENTS

| | | | |
|---|---|---|---|
| 2,198,237 | 4/1940 | Voorderman | 37/43 E |
| 2,706,864 | 4/1955 | Kear | 37/43 R |
| 2,919,504 | 1/1960 | Rubin | 37/43 R |
| 3,021,661 | 2/1962 | Couberly | 37/43 D |
| 3,303,588 | 2/1967 | Krause | 37/43 R |
| 3,359,661 | 12/1967 | Speiser et al. | 37/43 R |
| 3,452,460 | 7/1969 | Cope et al. | 37/43 D |
| 3,468,041 | 9/1969 | Mattson et al. | 37/43 E |
| 4,138,829 | 2/1979 | Chase | 37/43 R |
| 4,138,830 | 2/1979 | Chase | 37/43 R |
| 4,138,831 | 2/1979 | Chase | 37/43 R |
| 4,190,972 | 3/1980 | Berner | 37/43 D |

FOREIGN PATENT DOCUMENTS

| | | | |
|---|---|---|---|
| 2130553 | 2/1972 | Fed. Rep. of Germany | 37/43 E |

*Primary Examiner*—E. H. Eickholt

*Attorney, Agent, or Firm*—Fulwider, Patton, Rieber, Lee & Utecht

[57] ABSTRACT

A snow thrower comprising a shock resistant drive system for rotating a cylindrical drum having a plurality of outwardly radiating paddles for scraping snow from pavement or the like. The snow is thrown by the paddles into communication with a directional vane assembly adjustable for deflecting the snow to either side.

21 Claims, 5 Drawing Figures

Fig. 1
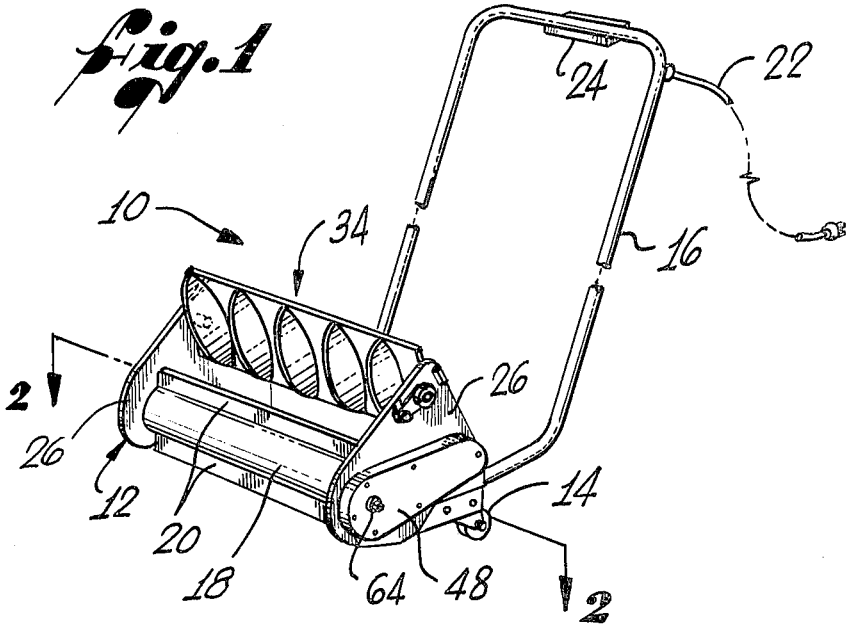
Fig. 4
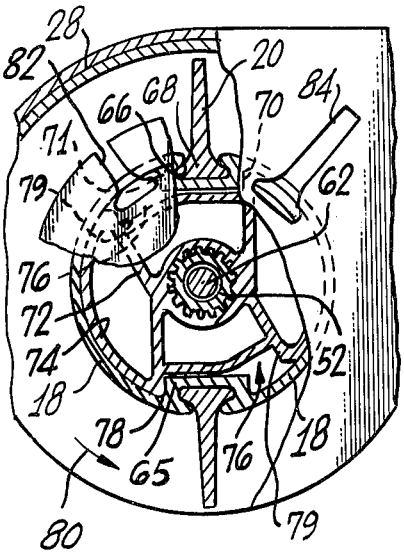
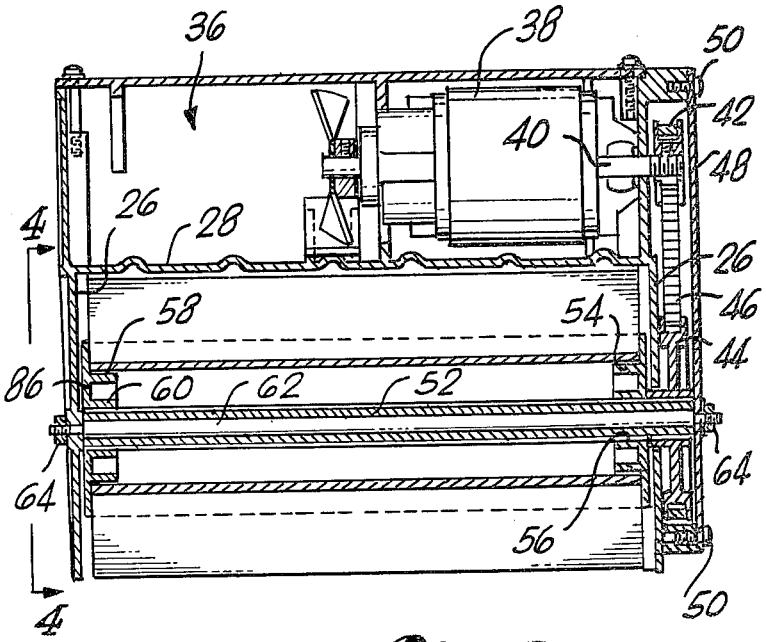
Fig. 2

SNOW THROWER

BACKGROUND OF THE INVENTION

This invention relates to power-driven implements for clearing snow from pavement or other relatively smooth surfaces. More specifically, this invention relates to an improved snow thrower having a relatively shock resistant drive system, and a directional vane assembly which is quickly and easily adjusted for deflecting thrown snow to either side of the implement.

Snow throwers in general are relatively well known in the art, and typically comprise a rotatably driven drum carrying one or more horizontally elongated blades. The drum and the blades are positioned whereby the blades pick up snow from a surface such as pavement or the like and throw the snow away from the surface to provide a snow-free cleared path.

Snow throwing implements of the prior art commonly include a suitable driving motor such as an electric motor or gasoline engine portably carried with the unit. This driving motor is connected through suitable speed-reduction apparatus, such as sprocket wheels, to rotatably drive the drum carrying the blades. The sprocket wheels are coupled together for rotation by positive, non-slip drive means such as chains or cog belts to prevent slippage when the implement is used for plowing through deep or heavy snow. However, with these positive drives, the driving connection between the motor and the rotating drum is relatively rigid to result frequently in breakage of the drum, blades, drive belt, or the like whenever relatively large and hard objects such as rocks are encountered.

Prior art snow throwing implements are also commonly provided with a directional deflection assembly for deflecting thrown snow to one side of the implement during use. See, for example, U.S. Pat. No. 2,919,504. Of course, it is desirable to adjust this directional deflection assembly for throwing snow alternately to one side of the implement, and then to the opposite side of the implement during successive passes back and forth over a relatively large area of pavement or the like. To this end, a variety of adjustable directional vane assemblies are found in the prior art. Some of these vane assemblies comprise relatively complicated mechanical structures including rigid vanes pivotable angularly back and forth to provide the desired directional control. See, for example, U.S. Pat. Nos. 4,138,829; 4,138,830; and 4,138,831. Other prior art vane assemblies include flexible vanes which are physically flexed by operation of a mechanical shift carriage for direction of thrown snow to one side of the implement, or to the other side of the implement. See, for example, U.S. Pat. Nos. 2,706,864 and 3,359,661. However, all of these prior art adjustable directional vane assemblies comprise relatively complicated mechanical structures formed from a relatively large number of mechanically movable components.

The present invention overcomes the problems and disadvantages of the prior art by providing an improved snow thrower implement including a shock-resistant drive system, and a simplified directional vane assembly which is quickly and easily adjusted for deflecting thrown snow to either side of the implement, as desired.

SUMMARY OF THE INVENTION

In accordance with the invention, a snow thrower comprises a portable wheeled frame or housing upon which is mounted a driving motor for rotatably driving a sprocket wheel disposed at one end of a horizontally extending rotatable drum carrying a plurality of elongated, outwardly radiating snow thrower paddles. The drum includes at its end adjacent the sprocket wheel a collar hub rotatably receiving a torsion bar driven by the sprocket wheel. The torsion bar extends axially through the drum to the opposite end of said drum, and is splined thereat to a drive hub for rotatably driving the drum.

A directional vane assembly is carried by the frame above and behind the rotating drum and paddles for deflecting thrown snow to either side of the snow thrower, as desired. The directional vane assembly comprises a deflector plate carried on spindle means for rotation about a horizontal axis. A locking lever connected to the spindle means is provided for rotating the deflector plate about said horizontal axis, and interacts with locking tabs on the frame to lock the deflector plate in either of two generally upstanding positions 180° from each other. Importantly, the deflector plate includes on one face a plurality of arcuately angled vanes which, when presented forwardly for communication with thrown snow, deflect the snow to one side of the snow thrower. On the opposite face of the deflector plate, a plurality of oppositely arcuately angled vanes are provided for deflecting thrown snow to the opposite side of the snow thrower when the deflector plate is rotated for communication of these latter vanes with the thrown snow.

BRIEF DESCRIPTION OF THE DRAWINGS

The accompanying drawings illustrate the invention. In such drawings:

FIG. 1 is a perspective view of a snow thrower of this invention;

FIG. 2 is an enlarged section taken on the line 2—2 of FIG. 1;

FIG. 4 is a fragmented end view taken on the line 4—4 of FIG. 2, with portions broken away.

DETAILED DESCRIPTION OF THE PREFERRED EMBODIMENT

Figure 3:
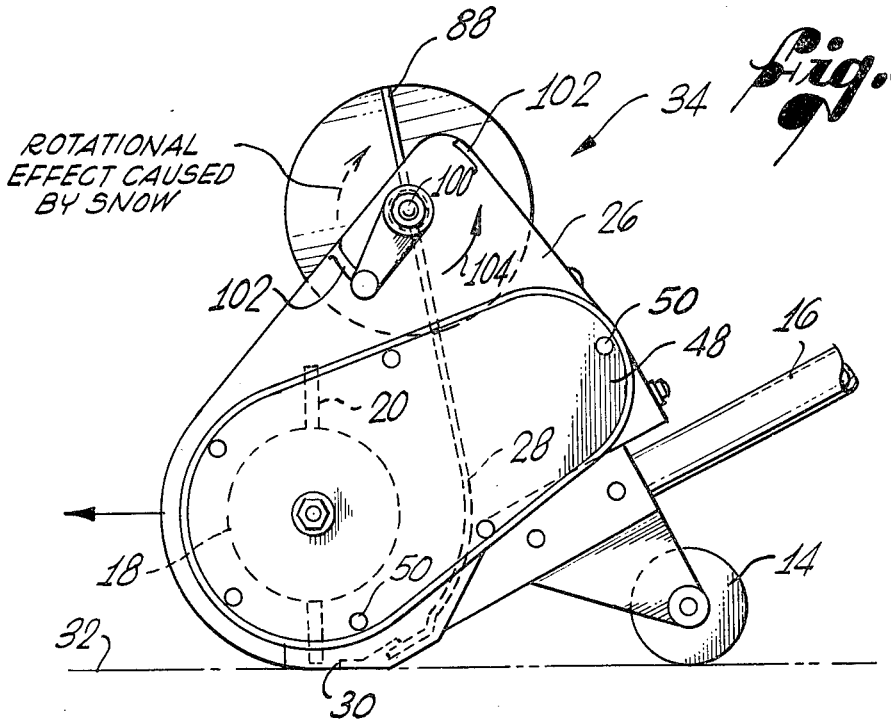
FIG. 3 is an enlarged fragmented end view of the snow thrower.

A snow thrower 10 is shown in FIG. 1, and generally comprises a frame or housing 12 portably supported upon wheels 14. The housing 12 is suitably guided along a desired path for picking up and throwing snow from the path by means of a rearwardly and upwardly extending handle 16. The snow is scraped from the path by means of a horizontally oriented drum 18 rotatably supported by the housing 12, and including a plurality of horizontally elongated and outwardly radiating paddles 20 for engaging the surface or path upon drum rotation for picking up and throwing snow away from the path. In the embodiment illustrated, the drum 18 is rotatably driven by an electric motor (not shown in FIG. 1) to which power is supplied via a power cord 22 connected to the handle 16, and controlled by a manual depression switch 24.

The snow thrower 10 is shown in more detail in FIGS. 2 and 3. As shown, the housing 12 comprises a pair of upstanding side plates 26 between which extends a deflector wall 28. This deflector wall 28 includes a lower, forwardly presented horizontal blade edge 30 over which the paddles 20 pass to push snow from a pavement or path 32 rearwardly onto the deflector wall 28. The deflector wall 28 curves rearwardly from the blade edge 30, as shown in FIG. 3, and then curves upwardly for guiding the thrown snow upwardly into a directional vane assembly 34. The vane assembly 34 is adjustable for deflection of the thrown snow to either side of the snow thrower 10, as desired and as controlled by the operator. The specific construction and details of this adjustable directional vane assembly 34 will be described herein in more detail.

The deflector wall 28 comprises the forward wall of a rear enclosure 36 forming a part of the housing 12. An electric motor 38 is mounted within this enclosure 36 for providing a rotational output via a main drive shaft 40. The drive shaft 40 drivingly rotates a relatively small cog wheel 42 at a relatively high rotational speed, and this rotational motion is positively and directly connected to a relatively large driven cog wheel 44 by a cog belt 46 received about said wheels 42 and 44. Both the driving cog wheel 42 and the driven cog wheel 44, together with the cog belt 46, are disposed generally in a common vertical plane at one end of the housing 12 outside the adjacent side plate 26, and are conveniently enclosed behind a protective guard plate 48 secured to the side plate 26 as by screws 50.

The driven cog wheel 44 is internally splined for matingly receiving in rotational driving engagement one end of an externally splined hollow torsion bar 52. From the cog wheel 44, the torsion bar 52 extends horizontally through a collar hub 54 secured within the adjacent end of the drum 18. Importantly, the collar hub 54 includes a cylindrical inner collar 56 for passage of the torsion bar 52 without driving engagement therewith. Accordingly, the collar hub 54 supports the associated end of the drum 18 with respect to the torsion bar 52, but does not transmit driving rotation from the torsion bar 52 to the drum 18.

From the collar hub 54, the torsion bar 52 extends horizontally through the drum 18 along the central drum axis to the opposite end of the drum. The opposite end of the torsion bar 52 terminates short of the opposite side plate 26, and is drivingly received within a drive hub 58 received within the adjacent end of the drum 18. This drive hub 58 includes an inner collar 60 which is internally splined for driving engagement with the externally splined torsion bar 52. The entire subassembly including the drum 18 and hubs 54 and 58, together with the driven cog wheel 44 and the torsion bar 52 are secured for rotation about a common horizontal axis by a support shaft 62 received through the torsion bar 52 and secured at its opposite ends to the housing 12 by threaded nuts 64.

The drive system of the snow thrower of this invention thus comprises a shock-resistant drive system so as to allow the paddles 20 and the drum 18 to accommodate large hard objects such as rocks or the like without breakage of components. Specifically, the rotational drive is transmitted by the driven cog wheel 44 directly to the torsion bar 52, and then via the torsion bar 52 to the drive hub 58 at the opposite end of the drum 18. Importantly, the torsion bar 52 comprises a torsionable material whereby the torsion bar 52 twists slightly about its longitudinal axis whenever the paddles 20 and the drum 18 encounter large, hard objects. Such twisting of the torsion bar 52 provides a flexible accommodation of relative motion between the positively driven cog wheel 44 and the hub 18 to prevent breakage of components.

The drive hub 58 and the drum 18 are specifically configured for rapid and easy changing of the paddles 20 in the event of excessive paddle wear. Specifically, as shown in FIG. 4, the drum 18 comprises a generally cylindrical tube interrupted at diametrically opposite positions by a pair of horizontally elongated paddle supports 65 each defining a pair of radially inwardly presented shoulders 70 and 71. Each paddle support 65 includes an elongated dovetail recess 66 for reception and containment of a paddle 20 having a matingly configured dovetail base 68.

The drive hub 58 comprises a vertically oriented end plate 86 formed integrally with an axially extending complex web 72 emanating generally radially from the internally splined collar 60. The web 72 defines a pair of arcuately formed bearing flanges 74 for close sliding reception into the adjacent end of the drum 18. These bearing flanges 74 terminate over a portion of the hub periphery to form a pair of opposed arcuate recesses 76 each bounded by a pair of radial projections 78 and 79. The arcuate lengths of these recesses 76 are each at least about twice the arcuate lengths of the associated dovetail recesses 66 in the paddle supports 65 of the drum 18.

As shown in FIG. 4, the projections 78 on the hub 58 are engageable with the shoulders 70 of the paddle supports 65 to rotatably drive the drum 18 as illustrated by arrow 80. However, when it is desired to change one or both of the paddles 20, the drum 18 and hub 58 are manually rotated in a reverse direction to rotationally back the projections 78 out of engagement with the shoulders 70. This movement serves to rotate the dovetail recesses 66 of the drum 18 into axial alignment with mating dovetail openings 82 formed in in the end plate 86 of the hub 58. Further rotation of the drum 18 moves one of the dovetail recesses 66 and the dovetail opening 82 into axial alignment with an opening 84 formed in the adjacent side wall 26 of the frame 12 and shaped for longitudinal passage of one of the paddles 20. In this position, one of the paddles 20 is quickly and easily slid out of its dovetail slot 66, and replaced by a new paddle 20. Rotation of the drum is then possible for aligning successive paddles 20 with the opening 84 in the side wall 26 for replacement. Upon replacement of a paddle 20, the hub 58 and drum 18 are once again manually rotated with respect to each other to bring the projections 78 back into driving engagement with the shoulders 70.

Figure 5:
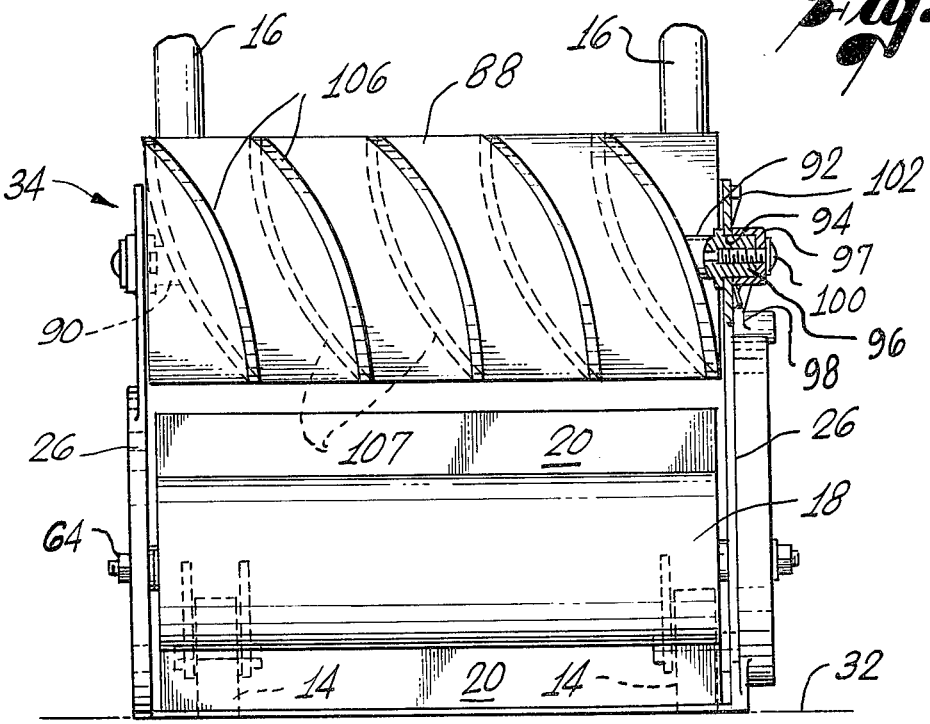
FIG. 5 is an enlarged fragmented front elevation of the snow thrower, with portions broken away.

Snow thrown upwardly by the paddles 20 on the drum 18 is deflected to either side of the snow thrower 10 by means of the adjustable directional vane assembly 34, as shown in FIGS. 3 and 5. This vane assembly 34 comprises an upstanding deflector plate 88 including integrally formed spindles 90 and 92 at opposite ends thereof. The spindles 90 and 92 are received through the opposite side plates 26 for supporting the deflector plate 88 for rotation about a horizontal axis. As shown in FIG. 5, the spindle 92 is received through an opening 94 in the side plate 26 and terminates in an hexagonal end 96. The end 96 carries a cap 97 secured thereover by a screw 100. The cap 97 is rotated by means of a locking lever 98 for controllably rotating the deflection plate 88 about its horizontal axis. Importantly, the locking lever 98 is securable in one of two diametrically opposed positions with respect to a pair of locking tabs 102 to lock the defelector plate 88 in one of two generally upstanding positions in alignment with the upper end of the housing deflector wall 28. More specifically, as shown in FIG. 3, the locking tabs 102 comprise a pair of inclined ramps, with the locking lever 98 being rotatable in the direction or arrow 104 for movement up either one of the ramps. However, movement of the locking lever 98 off the stepped end of either ramp causes the lever to drop off the associated stepped end for prevention of reverse rotation of the deflector plate 88. During operation, snow thrown upwardly by the paddles 20 tends to rotate the deflector plate 88 in a direction opposite arrow 104, whereby the thrown snow retains the plate 88 in the selected one of the two rotational positions with the locking lever 98 in engagement with the stepped end of one of the locking tabs 102.

The deflector plate 88 has integrally formed on one face thereof a plurality of laterally spaced arcuate deflector vanes 106, and a corresponding plurality of laterally spaced arcuate deflector vanes 107 on opposite face. These vanes 106 and 107 all have a generally semicircular profile. The vanes 106 are identically shaped and curved for deflecting snow to one side of the snow thrower, whereas the vanes 107 on the opposite face of the plate 88 are all identically shaped and curved for deflecting snow to the opposite side of the snow thrower. The direction of snow deflection is specifically chosen by the operator quickly and easily by 180° rotation of the locking lever 98 to rotate correspondingly the deflector plate 88. Conveniently, as illustrated in FIG. 5, the opposite spindles 90 and 92 are formed to have a generally semicircular cross section so as not to interfere with snow thrown between the vanes 106 and 107.

A wide variety of modifications and improvements to the snow thrower of this invention are believed to be possible to one skilled in the art. For example, a gasoline-powered engine or the like may be substituted for the electric motor disclosed in the preferred embodiment. Moreover, alternate positive drive apparatus may be used, such as lubricated gears or the like. Still further, many of the components such as the torsion bar 52, drum 18, and the hubs 54 and 58 may be inexpensively formed from appropriate extruded plastics or the like. Accordingly, no limitation upon the invention is intended except as set forth in the appended claims.

We claim:

1. A snow thrower, comprising:

a housing;

means carried by said housing for picking up snow, and for throwing the snow generally upwardly from said housing;

deflector means carried for rotation with respect to said housing, and including a plurality of first deflector vanes rotatable to a position for deflecting thrown snow to one side of said housing, and a plurality of second deflector vanes rotatable to a position for deflecting thrown snow to the other side of said housing; and locking means for locking said deflector means in a first rotatable position with said plurality of first deflector vanes in deflecting communication with the thrown snow and said plurality of second deflector vanes out of deflecting communication with the thrown snow, and a second rotatable position with said plurality of second deflector vanes in deflecting communication with the thrown snow and said plurality of first deflector vanes out of deflecting communication with the thrown snow.

2. The snow thrower of claim 1, wherein said housing includes a pair of generally upstanding opposed side plates, and wherein said deflector means comprises an elongated deflector plate extending between said side plates, and spindle means for supporting said deflector plate for rotation with respect to said side plates about a horizontal axis.

3. The snow thrower of claim 2 wherein said plurality of first deflector vanes comprises a plurality of laterally spaced, generally arcuately curved vanes formed on one face of said deflector plate, and wherein said plurality of second deflector vanes comprises a plurality of laterally spaced, generally arcuately and oppositely curved vanes formed on the opposite face of said deflector plate.

4. The snow thrower of claim 3 wherein each of said plurality of first deflector vanes and each of said plurality of second deflector vanes has a generally semicircular cross section.

5. The snow thrower of claim 1 wherein said deflector means is formed integrally with said plurality of first deflector vanes and said plurality of second deflector vanes.

6. The snow thrower of claim 2 wherein said locking means comprises a locking lever connected to said spindle means for rotating said deflector plate, and a pair of locking tabs on one of said side plates and each engageable by said locking lever for retaining said locking lever in a selected one of two rotational positions for preventing rotation of said spindle means and said deflector plate.

7. The snow thrower of claim 6 wherein said locking tabs comprise a pair of inclined ramps formed generally in diametrically opposed relation to each other, said ramps each being oriented to engage said locking lever when snow is thrown upwardly from said housing to prevent rotation of said spindle means and said deflector plate.

8. A snow thrower comprising:

a housing:

means carried by said housing for picking up snow, and for throwing the snow generally upwardly from said housing;

and deflector means carried on said housing and including a plurality of first vanes for deflecting thrown snow to one side of said housing and a plurality of second vanes for deflecting thrown snow to the opposite side of said housing, said deflector means being rotatable with respect to said housing between a first position with said first vanes in deflecting communication with the thrown snow and said second vanes out of deflecting communication with the thrown snow, and a second position with said second vanes in deflecting communication with the thrown snow and said first vanes out of deflecting communication with the thrown snow.

9. The snow thrower of claim 8 including locking means for locking said deflector means in either one of said first and second positions.

10. The snow thrower of claim 8 wherein said housing includes a pair of generally upstanding opposed side plates, and wherein said deflector means comprises an elongated deflector plate extending between said side plates, and spindle means for supporting said deflector plate for rotation with respect to said side plates about a horizontal axis.

11. The snow thrower of claim 10 wherein said plurality of first deflector vanes comprises a plurality of laterally spaced, generally arcuately curved vanes formed on one face of said deflector plate, and wherein said plurality of second deflector vanes comprises a plurality of laterally spaced, generally arcuately and oppositely curved vanes formed on the opposite face of said deflector plate.

12. The snow thrower of claim 9 wherein said locking means comprises a locking lever connected to said spindle means for rotating said deflector plate, and a pair of locking tabs on one of said side plates and each engageable by said locking lever for retaining said locking lever in a selected one of two rotational positions for preventing rotation of said spindle means and said deflector plate.

13. The snow thrower of claim 12 wherein said locking tabs comprise a pair of inclined ramps formed generally in diametrically opposed relation to each other, said ramps each being oriented to engage said locking lever when snow is thrown upwardly from said housing to prevent rotation of said spindle means and said deflector plate.

14. A snow thrower, comprising:

a housing;

means carried by said housing for picking up snow, and for throwing the snow generally upwardly from said housing;

a deflector plate carried for rotation with respect to said housing, said plate including on one face thereof a plurality of first deflector vanes shaped for deflecting thrown snow to one side of said housing, and on the other face thereof a plurality of second deflector vanes shaped for deflecting thrown snow to the other side of said housing; and means for selectively rotating said deflector plate to a first position with said first vanes in deflecting communication with the thrown snow, and to a second position with said second vanes in deflecting communication with the thrown snow, said rotating means including locking means for locking said deflector plate in one of said first and second positions.

15. A snow thrower comprising:

a housing having a pair of opposed, upstanding side plates;

a generally cylindrical drum including means defining a plurality of elongated generally dovetail-shaped recesses;

a plurality of elongated paddles each having a generally dovetail-shaped base for sliding reception into associated ones of the recesses formed in said drum;

a pair of hubs received within opposite ends of said drum, one of said hubs being at least partially rotatable with respect to said drum and including at least one opening formed therein for alignment with at least one of said paddles to permit sliding passage of said paddle into and out of said associated recess in said drum through said opening;

means for rotatably supporting said hubs with respect to said housing for rotation of said drum about a horizontal axis; and means connected to at least one of said hubs for rotatably driving said drum whereby said paddles pick up snow, and throw the snow generally upwardly from said housing.

16. The snow thrower of claim 15 wherein said recess-forming means on said drum includes a radially inwardly directed shoulder, said one of said hubs including an arcuate peripheral space for receiving the adjacent end of said recess-forming means on said drum, and including a radial projection, said one hub being rotatable with respect to said drum between a first position with said projection in rotatable driving engagement with said shoulder and a second position with the opening formed in said one hub in alignment with at least one of said paddles to permit sliding passage of said paddle through said opening longitudinally with respect to said associated recess.

17. The snow thrower of claim 15 including an opening formed in said side plate adjacent said one hub for alignment with said opening in said one hub for sliding passage therethrough of one of said paddles.

18. A snow thrower comprising:

a housing having a pair of opposed, upstanding side plates;

a generally cylindrical drum including means extending longitudinally the substantial length of said drum forming a plurality of elongated, generally dovetailshaped recesses, said recess-forming means including at least one radially inwardly projecting shoulder;

a plurality of elongated paddles each having a generally dovetail-shaped enlarged base for sliding reception into associated ones of said recesses formed in said drum;

a first hub received within one end of said drum and being configured for preventing passage of said paddles longitudinally out of said recesses formed in said drum;

a second hub received within the other end of said drum, said second hub including an arcuate peripheral space for receiving the adjacent end of said recessforming means on said drum and including a radial projection, said second hub being rotatable with respect to said drum between a first position with said radial projection in rotatable driving engagement with said radially inwardly projecting shoulder, and a second position with an opening formed in said second hub aligned with at least one of said paddles to permit sliding passage of said paddle longitudinally through said opening with respect to said associated recess in said drum;

means for rotatably supporting said first and second hubs with respect to said housing for rotation of said drum about a horizontal axis; and means for rotatably driving at least one of said hubs for rotatably driving said drum whereby said paddles pick up snow, and throw the snow generally upwardly from said housing.

19. The snow thrower of claim 18 including an opening formed in said side plate adjacent said second hub for alignment with said opening in said second hub for sliding passage therethrough of one of said paddles.

20. A snow thrower, comprising:

a housing;

a drum carried by said housing for rotation about a generally horizontal axis;

a plurality of horizontally elongated paddles radiating outwardly from said drum for picking up snow, and for throwing the snow generally upwardly from said housing upon rotation of said drum;

drive means for rotatably driving said drum, said drive means including a hollow torsion bar received axially through said drum, a first hub at one end of said drum drivingly connected to said torsion bar, a second hub at the other end of said drum for non-driving passage of said torsion bar, and means for rotationally driving the end of said torsion bar adjacent said other end of said drum;

and a support shaft received through said torsion bar and secured to said housing for rotatably supporting said torsion bar, said first and second hubs, and said drum.

21. A snow thrower, comprising:

a housing;

a drum carried for rotation by said housing about a generally horizontal axis, and including a plurality of horizontally elongated paddles radiating outwardly for picking up snow, and for throwing the snow generally upwardly from said housing upon rotation of said drum;

motor means carried by said housing;

a hollow torsion bar received axially through said drum, said drum including a first hub at one end configured for driving engagement with said torsion bar and a second hub at an opposite end configured for nondriving passage of said torsion bar;

a support shaft received through said torsion bar and secured to said housing for rotatably supporting said torsion bar, said first and second hubs, and said drum; and positive drive means coupled between said motor means and one end of said torsion bar adjacent said second hub.

* * * * *